US005232300A

United States Patent [19]

Buchanan et al.

[11] Patent Number: 5,232,300

[45] Date of Patent: Aug. 3, 1993

[54] BRUSH DECONTAMINATION KIT

[75] Inventors: James G. Buchanan, Tabernacle; Walter A. Haine, Jr., Toms River; Russell R. Haines, Brielle, all of N.J.

[73] Assignee: Paco Pharmaceutical Services, Inc., Lakewood, N.J.

[21] Appl. No.: 822,473

[22] Filed: Jan. 17, 1992

[51] Int. Cl.[5] ..... A46B 11/00; A46B 11/02

[52] U.S. Cl. ..... 401/268; 401/4; 401/186; 401/269; 401/288

[58] Field of Search ..... 401/186, 268, 269, 270, 401/286, 288, 4, 132

[56] References Cited

U.S. PATENT DOCUMENTS

| | | | |
|---|---|---|---|
| 490,862 | 1/1893 | Brown | 401/4 |
| 1,335,896 | 4/1920 | Hyde | 401/288 |
| 2,729,505 | 1/1956 | Harvey | 401/186 X |
| 2,904,808 | 9/1959 | Massman | 401/4 |
| 4,850,729 | 7/1989 | Kramer et al. | 401/288 X |

FOREIGN PATENT DOCUMENTS

| | | | |
|---|---|---|---|
| 407977 | 3/1910 | France | 401/186 |
| 2345224 | 11/1977 | France | 401/132 |
| 427733 | 1/1967 | Switzerland | 401/268 |
| 2180739 | 4/1987 | United Kingdom | 401/288 |

OTHER PUBLICATIONS

Advertisement of the Oneshot ® roller of the Diagraph Corporation given on p. 4 of the Diagraph Corporation's 1992 catalog.

*Primary Examiner*—Steven A. Bratlie

*Attorney, Agent, or Firm*—Seidel, Gonda, Lavorgna & Monaco

[57] ABSTRACT

A squeezeable container for holding and dispensing decontaminating powder is disclosed. The squeezeable container comprises a brush assembly and gripping means. The brush assembly is attached to the top section of the container in a screw-like manner, and comprises a brush formed of bristles which have a portion that is heat set so as to be held together in a semi-rigid manner. The bristles are arranged to form a reservoir within the brush assembly. The reservoir has an exit section closed off by the semi-rigid bristles, and an entrance section closed off by a plug member. The gripping means has a first end attached to the plug member and a second end extending out of the semi-rigid bristles. The pulling of the gripping means removes the plug from the dispenser and opens the brush reservoir. A squeezing action of the container puffs the powder within the container into the brush reservoir, and movement of brush dispenses the powder over any designed contaminated area.

13 Claims, 6 Drawing Sheets

FIG. 1(a)
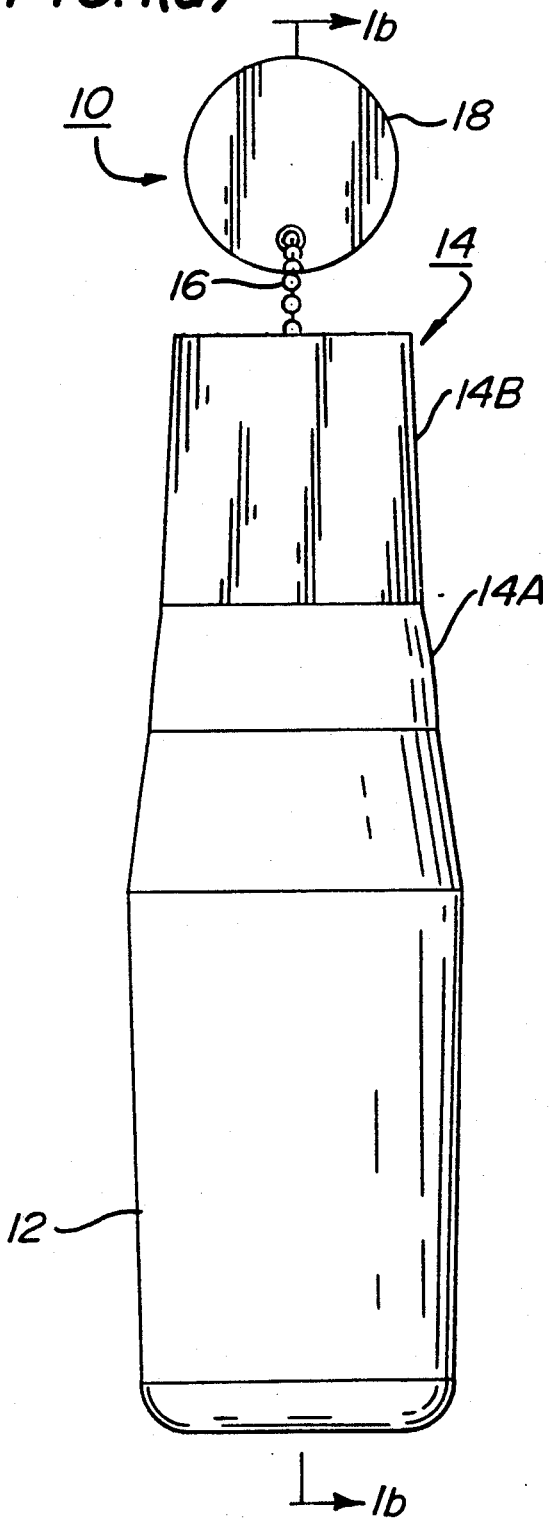
FIG. 1(b)
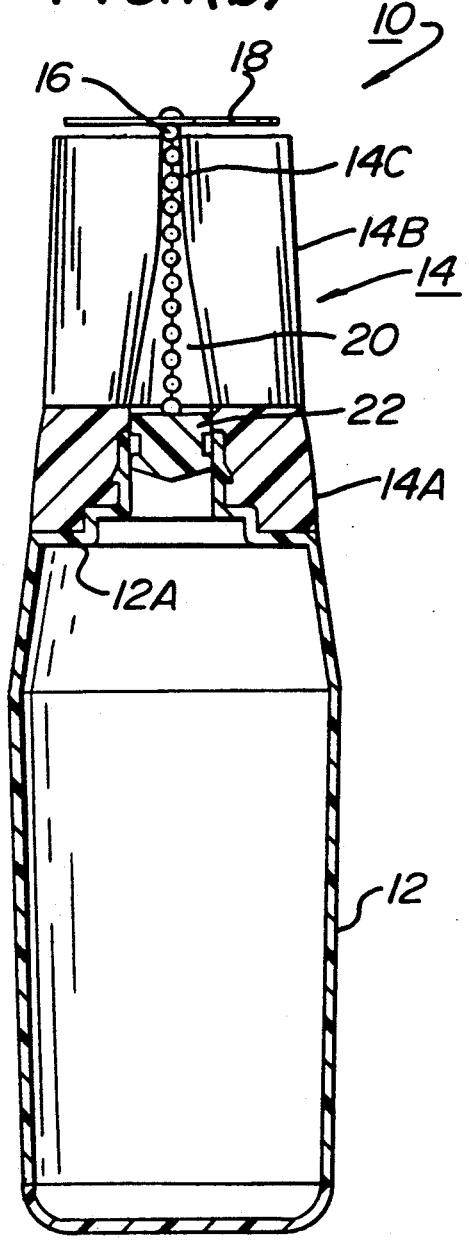
FIG. 1

FIG.2(a)
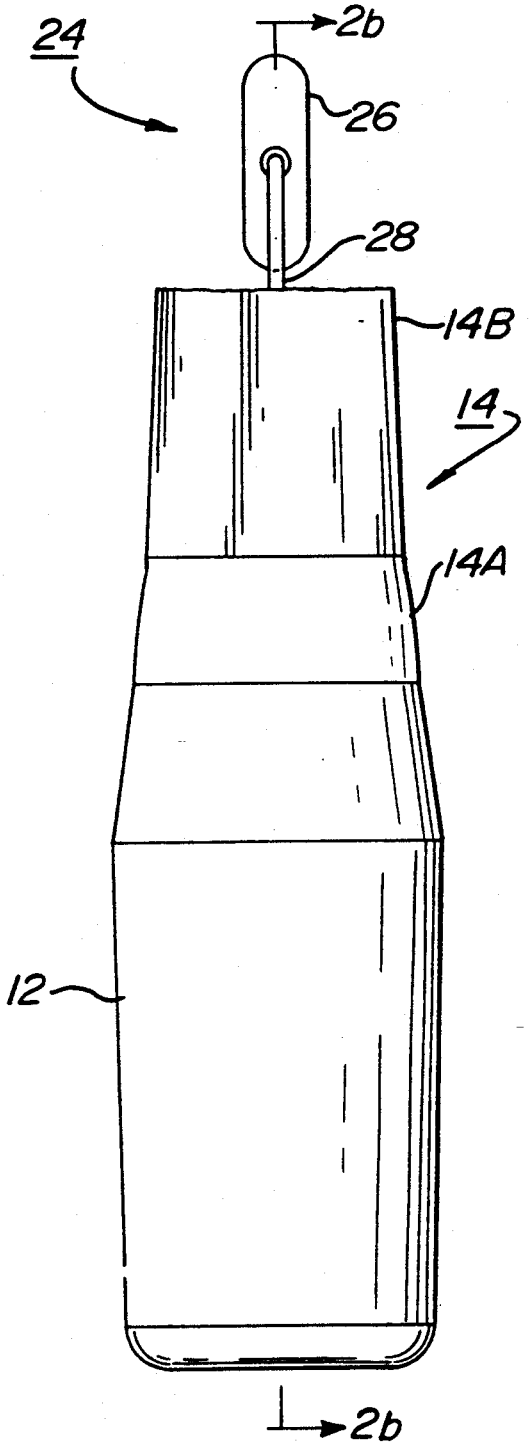
FIG.2(b)
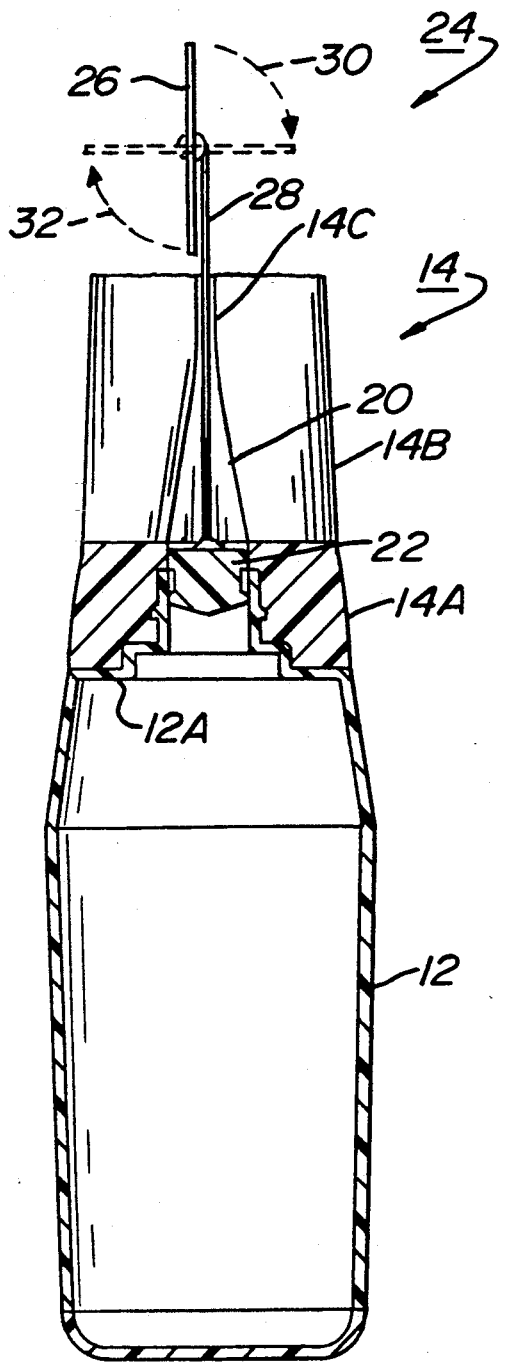
FIG.2

FIG. 4(a)
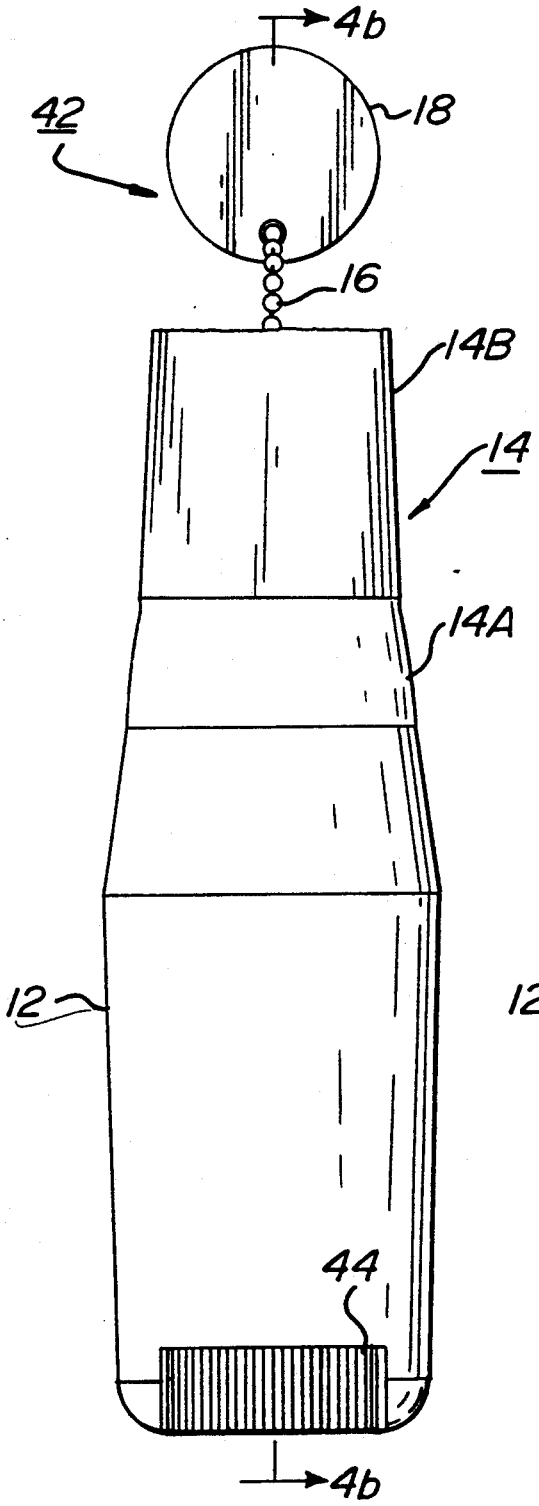
FIG. 4(b)
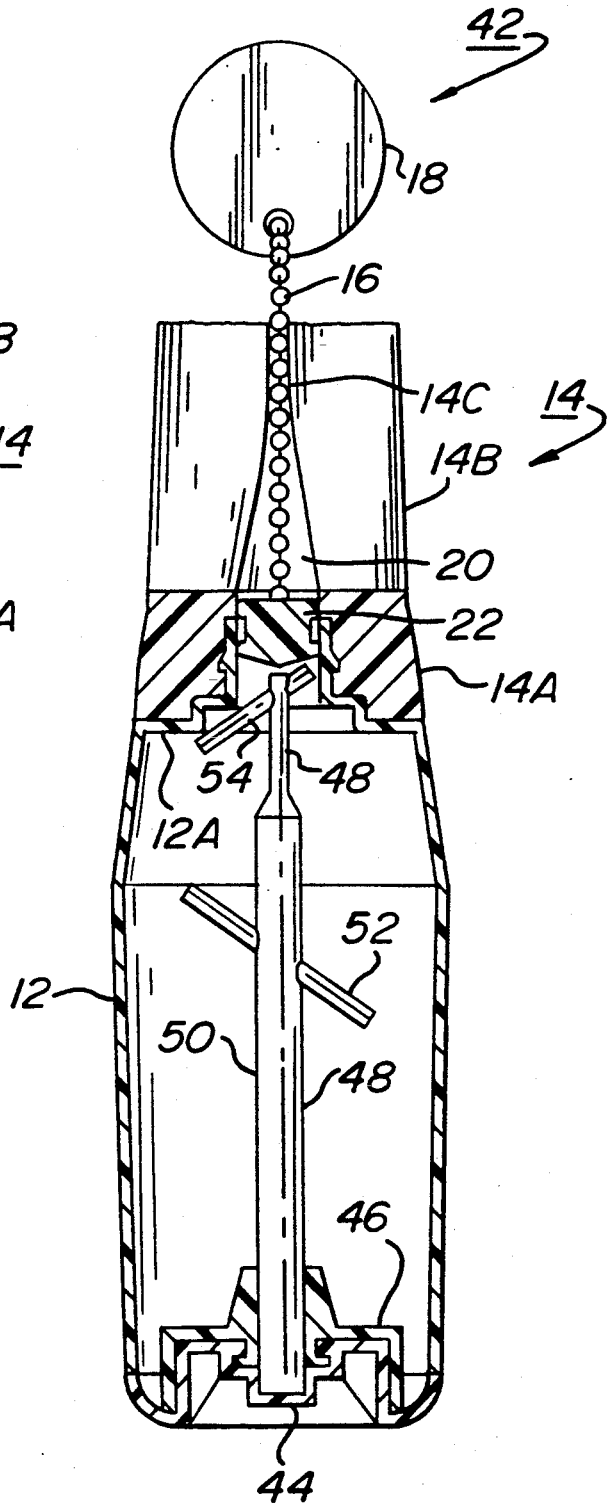
FIG. 4

FIG.5(a)
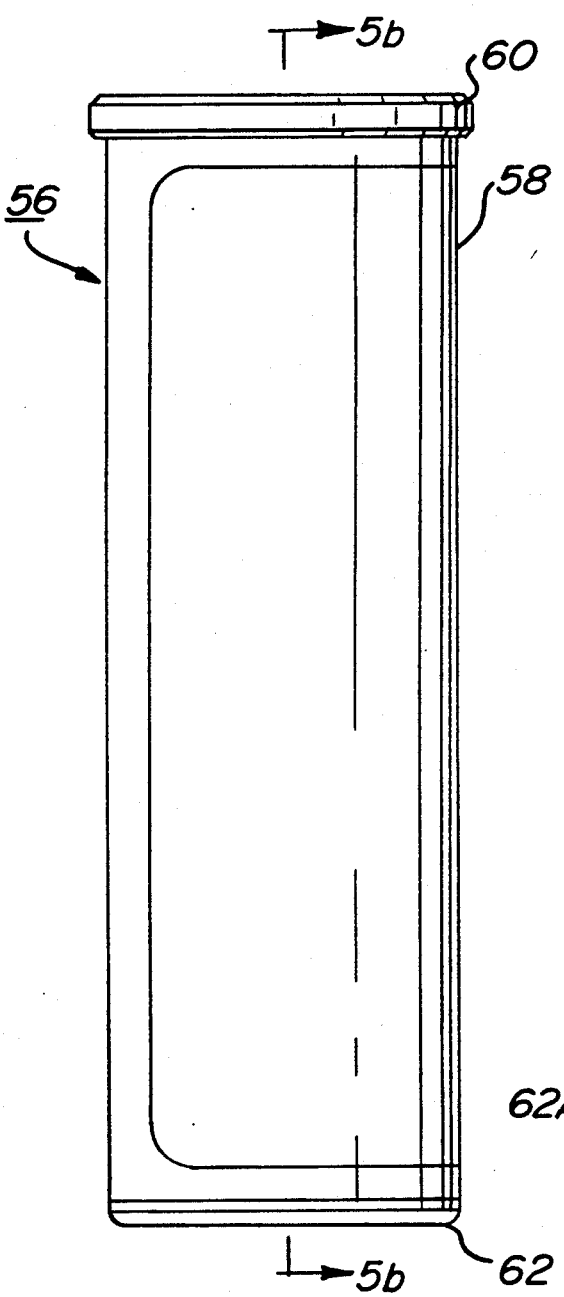
FIG.5(b)
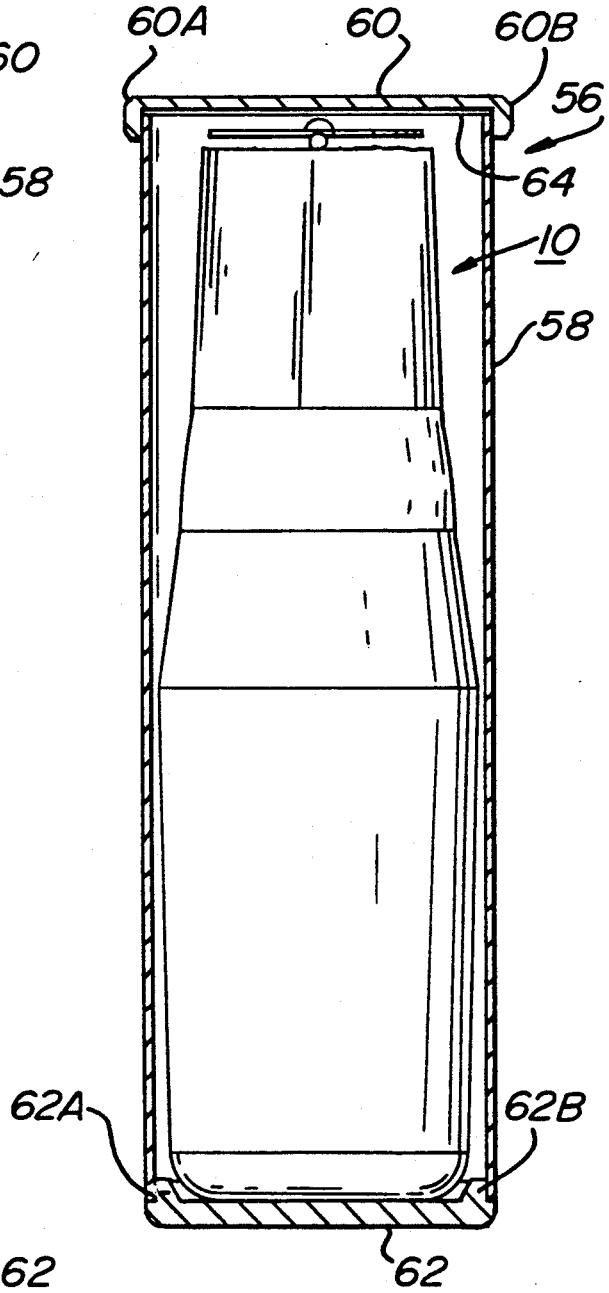
FIG.5

FIG. 6(a)
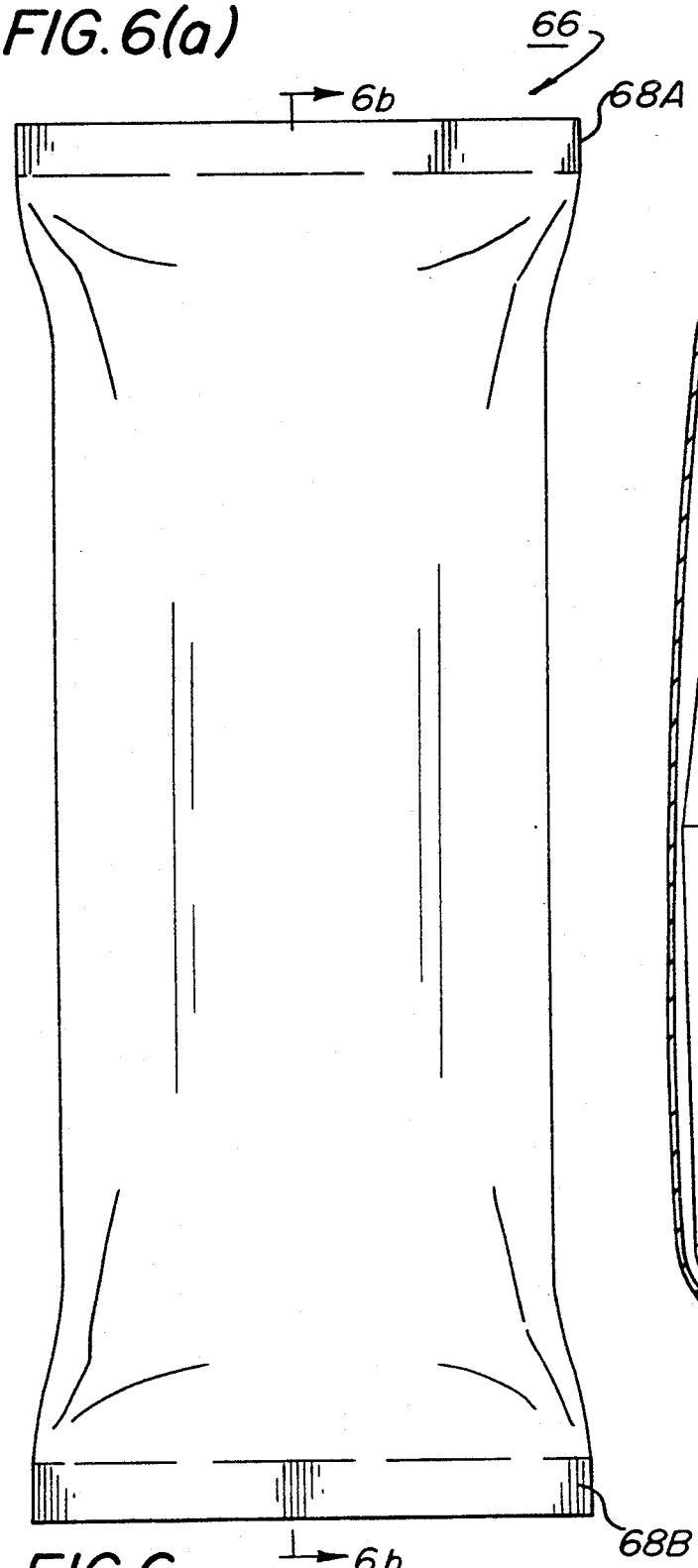
FIG. 6(b)
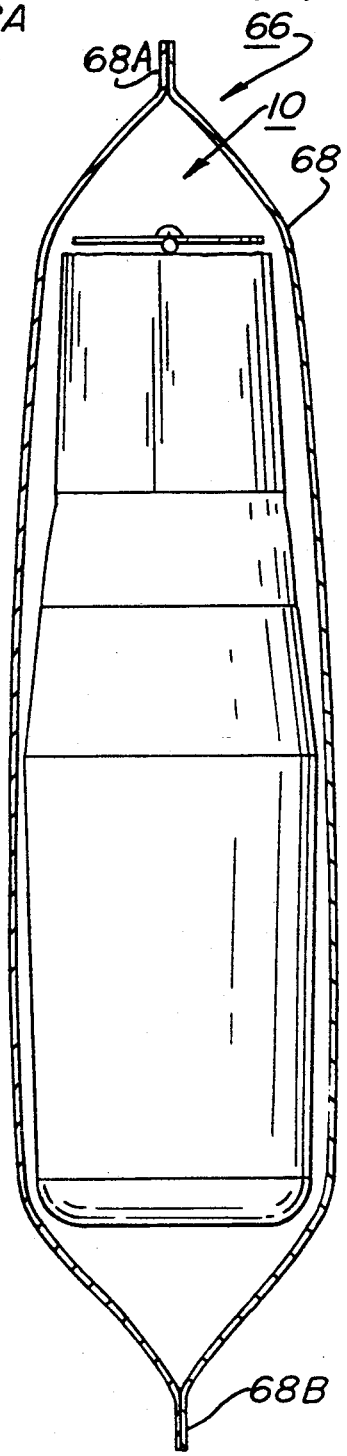
FIG. 6

BRUSH DECONTAMINATION KIT

FIELD OF THE INVENTION

The present invention is related to dispensing means, and more particularly, to a squeezeable container that holds and dispenses decontaminating powder, and has a brush assembly that allows the dispensed powder to be distributed over a contaminated area.

BACKGROUND OF THE INVENTION

In certain applications, it is of particular importance that a dispensing means deliver its a contained material directly onto a designated area. For example, if the dispensing means holds a decontaminating powder, it is extremely important that this powder be dispensed directly onto an area that has been contaminated by a poisonous substance. Further, it is important that this decontaminating powder then be distributed so as to cover completely the contaminated area. In such applications, the powder may be of a free-flowing type and the contaminated area may be remotely located requiring the powder to be carried to the area. Further, the contaminated area may be difficult to reach and have an uneven surface.

Commonly, the decontaminating powder is contained in a pouch package having tearable portions that allow the powder to be poured, in a stream like manner, onto the contaminated area. The use of this pouch package to deliver the decontamination powder is undesired, particularly when the area to be decontaminated is uneven, and even downwardly sloped, such that any poured powder immediately leaves the contaminated area before it has time to counteract the poisonous substance. Further, in certain applications it is desired that the dispensed powder be moved or spread so as to be distributed over all of the contaminated area.

The problem of dispensing decontaminated material is further hindered when the decontaminated powder of a non-free flowing type. During such situations, the pouch holding the non-free flowing powder, must first be agitated so that the powder is made to transition into a free-flowing type. More than likely, such agitation does not completely break up or mix the non-free flowing powder so that lumps and clusters of this powder remain and are present when the powder is poured from the pouch. The lumps and clusters have a tendency not to remain at the contaminated area, and furthermore, these lumps and clusters retard the effectiveness of the decontaminating powder in counteracting the poisonous substance. It is desired that means be provided to transition the non-free flowing powder into a free flowing state before it is dispensed. Further, it is desired that the free-flowing decontaminating powder be delivered to and distributed within the contaminated area regardless of its location or surface contour.

Accordingly, it is an object of the present invention to provide a dispenser having means that allows free-flowing powder to be dispensed and distributed over a decontaminating area.

It is a further object of the present invention to provide a dispenser means that transitions the non-free flowing powder to a free flowing type before it is dispensed onto the contamination area.

Still further, it is an object of the present invention to securely hold the decontamination powder within a container, while at the same time provide means that allows the release of the powder in a convenient and easy manner.

Further, it is an object of the present invention to provide means for holding the dispenser so that its contained powder is maintained in a dry condition while at the same time allowing such holding means to serve as a device to store or transport the dispenser.

Other objects and advantages of the present invention will become apparent to those skilled in the art with reference to the attached drawings and description of the invention which hereinafter follows.

SUMMARY OF THE INVENTION

The present invention is directed to a dispenser having a brush assembly that allows decontaminated powder to be delivered to and distributed within a contamination area.

The dispenser, in one embodiment, comprises a squeezeable container having an interior volume for holding powder and top and bottom sections as well as predetermined dimensions including its thickness, height and volume. The container comprises a brush assembly and gripping means. The brush assembly is attached to the top section of the container in a screw-like manner, and comprises a brush formed of bristles having a portion brought together to provide a semi-rigid cluster. The bristles are arranged to form a reservoir within the brush assembly. The reservoir has an exit section closed off by the semi-rigid cluster, and an entrance section closed off by a plug member. The entrance section is into the interior volume holding the powder and the plug member is removable and disposed intermediate the reservoir and the interior volume. The gripping means has a first end attached to the plug member and a second end extending out of the semi-rigid cluster. The gripping means is used to remove the plug member, and in so doing, causes the semi-rigid cluster to breakaway so that the exit section, as well as the entrance section of the reservoir are no longer closed off, and the dispenser is ready to deliver the powder to any designated area.

BRIEF DESCRIPTION OF THE DRAWINGS

For the purpose of illustrating the invention, there is shown in the drawings a form which is presently preferred; it being understood, however, that this invention is not limited to the precise arrangement and instrumentalities shown.

FIG. 1 is composed of FIGS. 1 (*a*) and (*b*) respectively illustrating an assembled view and a cut-away view of a first embodiment of a dispenser of the present invention for delivering free-flowing powder to a designated area.

FIG. 2 is composed of FIGS. 2 (*a*) and (*b*) respectively illustrating an assembled view and a cut-away view of a second embodiment of a dispenser of the present invention, particularly suited for delivering free-flowing powder.

FIG. 4 is composed of FIGS. 4 (*a*) and (*b*) respectively illustrating an assembly view and a cut-away view of another embodiment, particularly suited for dispensing nonfree flowing powder.

FIG. 5 is composed of FIGS. 5 (*a*) and (*b*) respectively illustrating an assembled view and a cut-away view of a canister used for storing or shipment of any of the embodiments of FIGS. 1–4, and for providing long-term stability of the contained powder.

FIG. 6 is composed of FIGS. 6 (*a*) and (*b*) respectively illustrating a top view, and a side cut-away view, of a foil pouch used for storing or shipment of any of the embodiments of FIGS. 1–4 and for providing long-term stability of the contained powder.

DETAILED DESCRIPTION OF THE PREFERRED EMBODIMENTS

Figure 3:
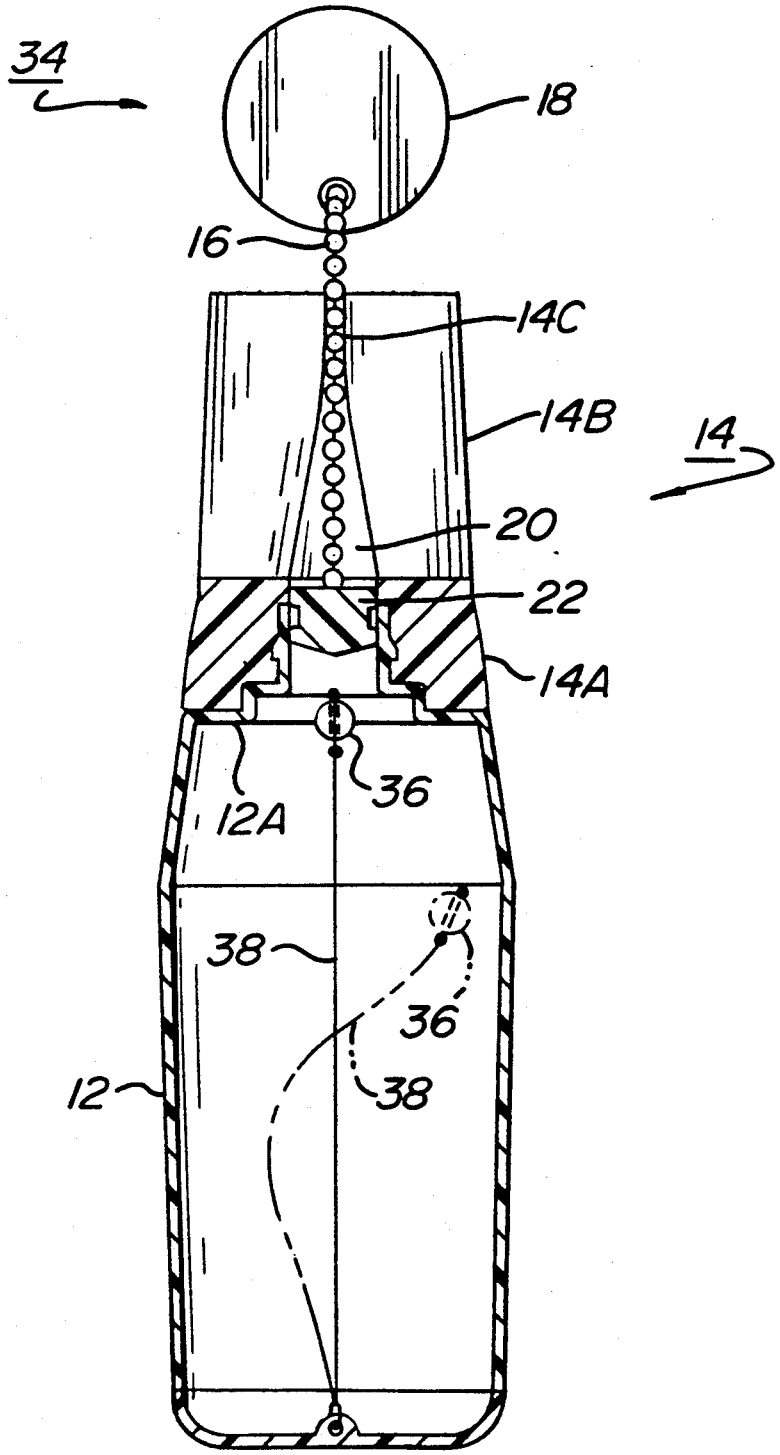
FIG. 3 is a cut-away view of another embodiment of the present invention particularly suited for dispensing non-free flowing powder.

Referring now the to drawings, wherein like numerals indicate like elements, there is shown in FIG. 1 a dispenser in the form of a squeezeable bottle 10 that dispenses its contents by being pressed, and has a brush assembly that allows the dispensed contents to be distributed in a sweeping, smoothing, scrubbing or painting-like manner. The dispenser 10 finds application in delivering and distributing a powder, such as a decontaminating powder, to an area that may have been contaminated by a substance, such as that having a poisonous affect.

FIG. 1 is composed of FIGS. 1 (*a*) and (*b*) respectively illustrating an assembled view and a cut-away view, taken substantially along line 1*b*—1*b* of FIG. 1 (*a*), of a first embodiment a dispenser 10 particularly suited for delivering free-flowing powder to a contaminated area. As shown in FIG. 1 (*a*), the squeezeable bottle 10 comprises a container 12, a brush assembly 14, and gripping means comprised of a chain member 16 and a pull-tag member 18.

The container 12 is comprised of a flexible plastic material, commonly formed from an injected molded process, and having a bottle circular-like shape. The container has predetermined dimensions that include its thickness, height, and volume. The thickness dimension of container 12, is selected to allow flexibility of its side portions in response to a squeezing action by a user. The height and volume dimensions are deterministic of the amount of material, such as decontaminating powder, that is confined or held within the interior volume of the container 12.

The brush assembly comprises a base 14A, and a brush 14B formed from flexible bristles. A portion of the bristles are heat set so as to form a cluster 14C (shown in FIG. 1 (*b*)) on the top surface of the brush 14B. The bristles of the cluster 14C have a semi-rigid condition in their undisturbed state, but are easily separated into flexible bristles by the removal of a plug member to be described. The chain member 16 extends out of the cluster 14C and may be further described, along with its associated pull-tag member 18, with further reference to FIG. 1 (*b*).

FIG. 1 (*b*) shows the pull-tag 18 in a laid flat, non-engageable condition. FIG. 1 (*b*) is a cut-away view which illustrate the internal elements of the dispenser 10. FIG. 1 (*b*) shows the base 14A as having a screw-like section that mates, in a complementary manner, with a screw-like portion 12A located at the top section of container 12.

The bristles of brush 14B of assembly 14 are arranged to form a reservoir 20. The reservoir 20 provides a passageway from the interior volume of the container 12 holding the powder to the brush 14B. The reservoir 20 has an exit section closed off by the cluster of bristles 14C and an entrance section into the interior volume of the container 12 and is closed off by a plug member 22. The plug member 22 is removable and disposed intermediate the reservoir and the interior volume of the container 12.

The gripping means of FIG. 1, also of FIGS. 3 and 4, is comprised of the chain 16 and pull-tag member 18. A first end of the chain 16 is affixed to the plug 20, while the second end of the chain 16 is connected to the pull-tag member 18. The chain 16, as seen in FIG. 1 (*b*), runs through the reservoir 20 and has a length sufficient to extend past the exit section of the reservoir 20 to allow, in a convenient manner, for its connection to the pull-tag member 18.

The pull tag member 18, as most clearly seen in FIG. 1 (*a*), allows for easy engagement or gripping by a user, so that when it is pulled, the connected chain 16 retracts the plug 22 (see FIG. 1 (*b*)) from the entrance section of the reservoir 20. The continued pulling of member 18 causes the plug member 22 to dislodge and separate the semi-rigid cluster 14 from the exit section of reservoir 20. When the plug member 22 is removed from the dispenser 10, the entrance and exit sections of the reservoir are no longer closed off. The separation of the bristles of cluster 14C by plug member 22 causes the bristles to revert to their flexible condition that was present before the heat-setting formed the cluster 14C. All of the bristles of 14B are now flexible and the squeezeable bottle 10 is available for dispensing its contained powder. A second gripping means related to the present invention that makes the related dispenser available for use may be described with reference to FIG. 2.

FIG. 2 is quite similar to the illustrations of FIG. 1, except for the showing of a second embodiment 24 as having of a gripping means comprised of a hinged pull-tag member 26 and a rod member 28. FIG. 2 (*a*), shows the hinged pull tag 26 in its dormant state arranged to be parallel with the rod 28. In the arrangement shown in FIG. 2 (*a*) the gripping means is not readily engageable by a user, whereas the active or engageable state of the hinged pull-tag 26 is shown in FIG. 2 (*b*) which is a cut-away view taken substantially along line 2*b*—2*b* of FIG. 2 (*a*).

The active or engage position of hinged pull-tag 26 is shown by a phantom representation, whereas, the non-engageable position of the pull-tag 26 is shown by a solid representation. The hinged pull-tag 26 is rotated from its non-engageable position to its engageable or operative position in a clockwise manner, as shown by arrows 30 and 32. The hinged pull-tag 26 is connected to the second end of rod 28 which, in turn, has its first end connected to the plug 22. The rod 28 is arranged within the reservoir 20 in a manner as previously discussed for chain 16.

The container 12, shown in both of the squeezeable containers 10 and 24 of FIGS. 1 and 2, respectively, preferably holds a free-flowing decontamination powder although a non-free flowing powder may also be used, but with less effectiveness. In operation, the squeezeable bottles are first made available for use by engaging the gripping means (16 and 18 of FIG. 1 or 24 and 26 of FIG. 2), and then removing the plug 22 in a manner as previously discussed. The flexible container 12 is then depressed, by a squeezing action, so that puffs of the decontamination powder are forced into the brush reservoir 20. The decontaminating powder is then delivered to and distributed within the contaminated area by means of sweeping, smoothing, scrubbing or painting-like motions. The squeezing action is repeated, as needed, so as to re-fill the chamber allowing for further vigorous or non-vigorous brushing of the powder, until all of the designated contaminated area is covered with the free-flowing decontaminated powder. The squeezeable container allows the decontaminating powder to be delivered to and distributed within any contaminated area regardless of the shape or contour of that area. This area may also include any confined area such as that which is found in an enclosure. The decontaminating powder may be brushed onto any such contaminated area within any such enclosure. The brushing action allows the decontaminating powder to find its way into any porous surface. The squeezeable container 10 having the brush assembly 14 serves as a kit to decontaminate any contaminated area.

It should now be appreciated, that the practice of the present invention, provides for a brush decontaminating kit in which decontaminated powder is dispensed onto and distributed over the designated area to be decontaminated. The brush decontaminating kit serves its intended purpose of readily dispensing and distributing the free-flowing decontaminated powder onto any contaminated area.

A second and third embodiment related to non-free flowing powder may be described with reference to FIGS. 3 and 4, in which FIG. 3 illustrates a cut-away view of a captive bead design of the squeezeable dispenser 34. The captive bead design comprises a tether-bead arrangement comprising a bead 36 that is affixed to one end of a string-like member 38 having its other end captured to the bottom portion of container 12 by means of an eyelet hook arrangement 40.

FIG. 3 illustrates the tether-bead arrangement with both a solid representation (dormant condition) and a phantom representation (active condition). From FIG. 3 it is seen that the tether-bead arrangement in its dormant condition has a length (solid representation) that is somewhat less the height of container 12, whereas the tether-bead arrangement in its active condition has a curved length. In operation, when the embodiment 34 is vigorously shaken, the tether and bead (shown in phantom) arrangement agitates the decontamination powder within the container 12 by a sufficient amount so that the powder transitions from a non-free flowing state to a free-flowing state. Upon the attainment of free flowing powder, the embodiment 34 is then squeezed so that the free flowing powder puffs into the reservoir 20, allowing for the decontamination powder to be readily dispensed in a manner as previously described for the embodiments of FIGS. 1 and 2.

A further embodiment of the present invention related to non-free flowing decontamination powder may be described with reference to FIG. 4 showing a dispenser 42. FIG. 4 is composed of FIGS. 4 (*a*) and (*b*) respectively illustrating an assembled view and cut-away view taken substantially along line 4*b*—4*b* of FIG. 4 (*a*). FIG. 4 is quite similar to the previously discussed FIG. 1, except for the addition of knurled knob 44 shown in FIG. 4 (*a*) and the interconnected components of the knob 44 shown in FIG. 4 (*b*).

From FIG. 4 (*b*), it is seen that the knurled knob 44 is positioned within a cut-out 46 and is attached to a rotatable shaft 48. The cut-out 46 has a U-shape and is located at the central portion of the bottom section of the container 12. The rotatable shaft 48 engages the knob 44 at this bottom section, and has an axis 50 that is centrally located within the container 12. The shaft 48 extends substantially through the overall height of the container 12. The shaft 48 has connected to it at least one paddle-like member 52 or 54. Each of the paddle members 52 and 54 is offset from the axis 50. The offset-paddle 52 is located on the central region of shaft 48, whereas the offset-paddle 54 is located on the top portion 48A of shaft 48 and near the screw-like top 12A of container 12. The paddles 50 and 54 are offset so as to more readily engage and mix the non-free flowing decontaminating powder within the container 12.

In operation, the knurled knob is engaged and rotated so that the paddles 52 and 54 contact and agitate the non-free flowing decontamination powder. The curled knob is continued to be rotated until the non-free flowing powder transitions to be that of a free-flowing decontamination powder. The free-flowing state of powder need not be complete so long as enough powder is made to be available to form into puffs by a vigorous squeezing action of the embodiment 42. This condition also applies to the embodiment 34 of FIG. 3. The pull-tag 18 of the grasping means of embodiment 42 is then engaged and pulled so that the plug member 22 is removed from the embodiment 42 in a manner as described for FIGS. 1, 2 and 3. Similarly, the embodiment 42 is then subjected to a squeezing action so that the free-flowing decontaminating powder is puffed into the reservoir 20. The decontamination powder is then distributed within the designated contamination area in a manner as described for FIGS. 1, 2 and 3.

It should now be appreciated that the practice of the present invention provides various embodiments that first allow non-free flowing decontaminated powder to be transitioned into a free-flowing state, and then allows such free-flowing powder to be readily distributed within a designated contaminated area.

All of the decontaminated powder of all of the embodiments of FIGS. 1–4 may be provided with a long-term stability characteristics by placing the squeezeable containers within either of the storage or transporting devices shown in FIGS. 5 and 6.

FIG. 5 is composed of FIGS. 5 (*a*) and (*b*) which respectively illustrates an assembled view of a canister 56 and a cut-away view of canister 56 taken substantially along line 5*b*—5*b* of FIG. 5 (*a*). The canister 56 has a main housing 58 having dimensions that slightly exceed the dimensions of the squeezeable containers of FIGS. 1–4 so as to accommodate the lodging of any of the containers within its confines. The main body 58 is closed at its top section by means of a cap 60 and at its bottom section by means of a base 62. All of the elements 58, 60 and 62 are preferably formed of a metal so as to retard any moisture from finding its way into the confines of the canister 56. The canister 56 may be further described with reference to FIG. 5 (*b*).

From FIG. 5 (*b*) it is seen that the canister 56 further comprises a foil membrane 64 positioned below cap 60 and comprises a thin soft pliable sheet that may be easily removed from the main body 58. The cap 60 has edges 60A and 60B that are separated from each other by an amount which exceeds the outer diameter of body 58 and allows for their engagement of the outer periphery of the main body 58. Conversely, the base 62 has ledges 62A and 62B that span between the inner diameter of body 68, and engage the inner periphery of the body 58. The base 62 provides a support platform for any of the squeezeable embodiments of FIGS. 1–4, such as squeezeable embodiment 10 shown in FIG. 5 (*b*) as being positioned within the confines of the canister 56.

A second device for storing or transporting any of the squeezeable embodiments for FIGS. 1–4 is shown in FIG. 6. FIG. 6 is composed of FIG. 6 (*a*) and (*b*) respectively illustrating a top view of a foil pouch 66 and a side view of foil pouch 66 taken substantially along line 6b—6b of FIG. 6 (*a*).

In a manner as described for FIG. 5, the foil member 66 comprises a pouch 68 which has dimensions that are selected so as to slightly exceed the dimensions of the squeezeable embodiments of FIGS. 1–4, thereby, providing a housing for accommodating the lodging of any of the containers of FIGS. 1–4. The foil pouch 68 is of a tearable type to allow access to any of the contained containers. The pouch 68 has respective top and bottom seal sections 68A and 68B. As shown in FIG. 6 (*b*), the separation between seal sections 68*a* and 68*b* provide a space which is sufficient for lodging any of the embodiments of FIGS. 1–4, such as, the squeezeable embodiment 10 shown in FIG. 6 (*b*).

It should now be appreciated the practice of the present invention provides for either a metal tube canister or a foil pouch each for housing any of the squeezeable embodiments of FIGS. 1–4 so as to protect the contained powder for moisture, and thereby allowing for long term stability of the decontamination powder within the confines of any of the squeezeable embodiments.

The present invention may be embodied in other specific forms without departing from the spirit or essential attributes thereof and, accordingly, reference should be made to the appended claims, rather than to the foregoing specification, as indicating the scope of the invention.

We claim:

1. A squeezeable container having an interior volume for holding powder and top and bottom sections as well as predetermined dimensions including its thickness, height and volume, said container comprising:

(a) a brush assembly attached to the top section of said container and comprising:

(i) a brush formed of bristles having a portion clustered together in a semi-rigid manner to form a cluster, and (ii) a reservoir located within said bristles, said reservoir having an exit section closed off by said semi-rigid cluster and an entrance section into said interior volume holding said powder and being closed off by a plug member, said plug member being removable and disposed intermediate said reservoir and said interior volume; and (b) gripping means having a first end attached to said plug member and a second end extending out of said semi-rigid cluster and connected to a pull member.

2. A squeezeable container according to claim 1, wherein said gripping means comprises a chain having a first end affixed to said plug member and a second end connected to said pull member, said chain running through said reservoir and having a length sufficient to extend past the exit section of the reservoir to allow for the connection to said pull member.

3. A squeezeable container according to claim 1, wherein said gripping means comprises a rod having a first end affixed to said plug member and a second end connected to said pull member, said rod running through said reservoir and having a length sufficient to extend past the exit section of the reservoir to allow for the connection to said pull member.

4. A squeezeable container according to claim 1, wherein said powder is of a free-flowing type.

5. A squeezeable container according to claim 3, wherein said pull member is of a hinged type.

6. A squeezeable container according to claim 1, wherein said powder is non-free flowing and wherein said container further comprises:

(a) a tether comprising a string-like member and having a first end affixed to the bottom-central region of said container, said tether having a length that is somewhat less than the height of said container and a free end; and (b) a bead member attached to the free end of said tether.

7. A squeezeable container according to claim 1, wherein said powder is non-free flowing and wherein said container further comprises;

(a) a central portion of the bottom section of said container having a U-shaped cut-out removed therefrom;

(b) a knurled knob positioned in said cut-out and attached to a rotatable shaft;

(c) said rotatable shaft having an axis that is centrally located, said shaft extending into the interior volume; and (d) at least one paddle-like member connected to the rotatable shaft and offset from the axis of the shaft.

8. A squeezeable container according to claim 1, further comprising:

(a) a hollow outer canister for containing the container and having a main body that has dimensions slightly exceeding said dimensions of said container so as to accommodate said container within it.

9. A squeezeable container according to claim 8, wherein said canister comprises metal.

10. A squeezeable container according to claim 8, wherein said canister comprises:

(a) a hollow main body having top and bottom sections and dimensions slightly exceeding said dimensions of said container;

(b) a base member closing off the bottom section of said hollow main body;

(c) a foil membrane closing off the top section of said hollow main body; and (d) a cap covering said foil membrane.

11. A squeezeable container according to claim 1, further comprising:

(a) a hollow outer pouch for containing the container and having a main body with dimensions that slightly exceed said dimensions of said container so as to accommodate said container within it.

12. A squeezeable container according to claim 11, wherein the pouch comprises a metal foil.

13. A squeezeable container according to claim 12, wherein said pouch is tearable.

* * * * *